US007665701B2

(12) United States Patent
Mitterbacher et al.

(10) Patent No.: US 7,665,701 B2
(45) Date of Patent: Feb. 23, 2010

(54) WALL-MOUNT BRACKET

(76) Inventors: Johannes Mitterbacher, Aredstrasse 29 Büro 222, A-2544 Leobersdorf (AT); Hans-Jörg Drobesch, Areedstrasse 29 Büro 222, A-2544 Leobersdorf (AT)

( * ) Notice: Subject to any disclaimer, the term of this patent is extended or adjusted under 35 U.S.C. 154(b) by 0 days.

(21) Appl. No.: 12/168,329

(22) Filed: Jul. 7, 2008

(65) Prior Publication Data

US 2009/0008522 A1 Jan. 8, 2009

(30) Foreign Application Priority Data

Jul. 5, 2007 (AT) ..... A 1040/2007

(51) Int. Cl.
*A47F 5/08* (2006.01)

(52) U.S. Cl. ..... 248/231.91; 248/250

(58) Field of Classification Search ..... 248/231.91, 248/250, 235, 247, 300
See application file for complete search history.

(56) References Cited

U.S. PATENT DOCUMENTS 2,890,853 A * 6/1959 D'Azzo ..... 248/273
3,403,641 A * 10/1968 Baker ..... 108/152
3,471,111 A * 10/1969 MacDonald ..... 248/235
4,666,117 A * 5/1987 Taft ..... 248/243
4,691,887 A * 9/1987 Bessinger ..... 248/250
4,733,843 A * 3/1988 Bessinger ..... 248/250
4,736,918 A * 4/1988 Bessinger ..... 248/250
4,765,575 A * 8/1988 Bergl et al. ..... 248/250
4,979,713 A * 12/1990 Bell ..... 248/224.8
5,064,158 A * 11/1991 Brazier et al. ..... 248/250
5,509,634 A * 4/1996 Gebka et al. ..... 248/316.7

FOREIGN PATENT DOCUMENTS

| | | |
|---|---|---|
| DE | 3005315 | 8/1981 |
| DE | 10149664 | 6/2002 |
| WO | WO-2005059268 | 6/2005 |

* cited by examiner

*Primary Examiner*—Anita M King
(74) *Attorney, Agent, or Firm*—Andrew Wilford

(57) ABSTRACT

A mounting bracket for securing to an upright wall has an anchor plate formed with an upper horizontally throughgoing mounting hole and having a back face engageable with the wall, and a support plate fixed to and extending horizontally from the anchor plate below the upper mounting hole. The back face is formed between the upper mounting hole and an upper edge of the anchor plate with a bevel having a bevel face extending upward away from the wall.

11 Claims, 4 Drawing Sheets

WALL-MOUNT BRACKET

FIELD OF THE INVENTION

The present invention relates to a mounting bracket. More particularly this invention concerns such a bracket used to secure a facade panel or the like on a building wall.

BRIEF DESCRIPTION OF THE DRAWING

The above and other objects, features, and advantages will become more readily apparent from the following description, reference being made to the accompanying drawing in which.

BACKGROUND OF THE INVENTION

A typical metal bracket has an anchor plate and a support plate projecting from it. The anchor plate has at least one mounting hole spaced from its upper edge and/or its lower edge.

Such brackets are known and serve in particular to mount building facade panels hung in front or for roof coverings. Such brackets are made of standard aluminum alloys and in order to reduce weight and lower the cost the wall thicknesses of the brackets are kept as small as possible. On the other hand, the dimensions and projections of the brackets should be possible within wide limits. Similar brackets of steel sheeting, that are welded bracket supports and that have totally different strength conditions, are not comparable to the subject matter of the invention.

DE 30 05 315 and DE 101 48 664 show the state of the art of such metal brackets in a simple embodiment. WO 2005/059268 shows a double-wall embodiment of a bracket. However, none of them offer a solution for the problem that occurs in the known aluminum brackets if a central bending out of the anchor plate of the bracket occurs as a result of heavy tractile loads. This bending out creates strong lever forces that act on the particular fasteners, normally mounting screws, and loosen them or even tear them out.

Figure 1:
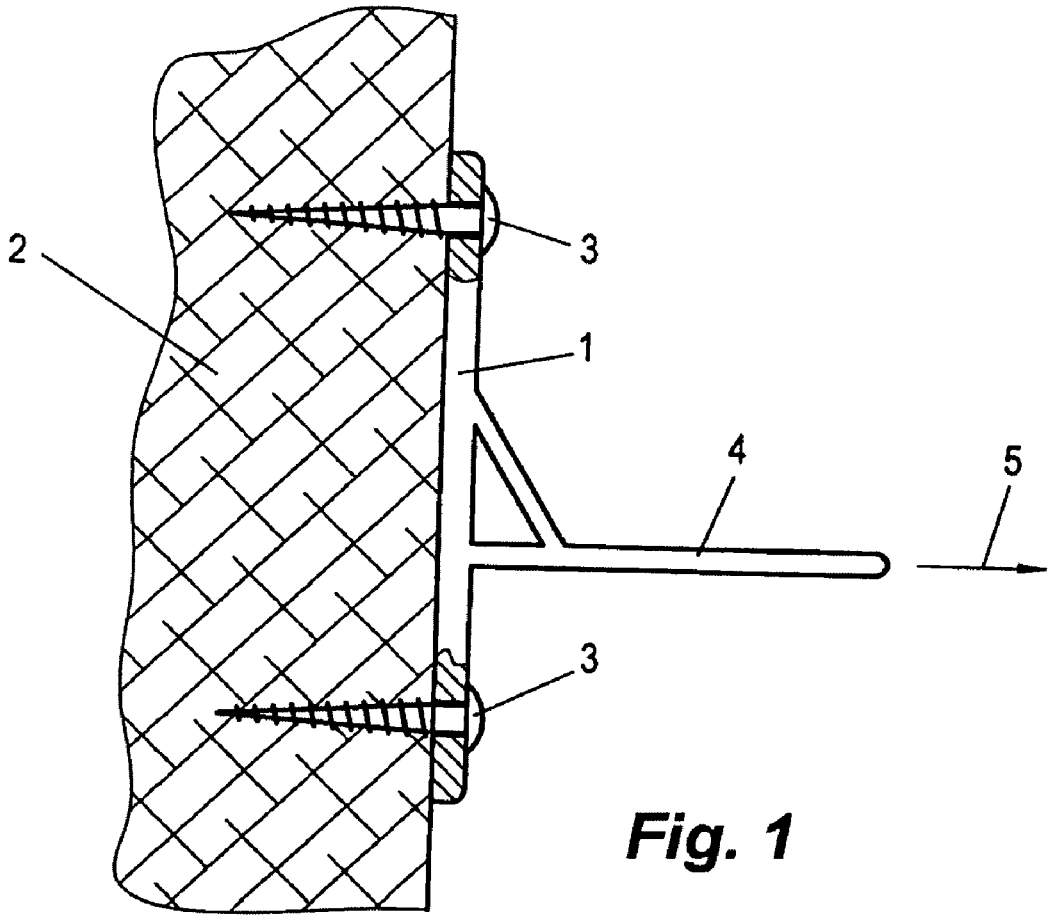
Fig. 1 Prior Art
FIGS. 1 and 2 are side partly sectional views through prior-art brackets.
Figure 2:
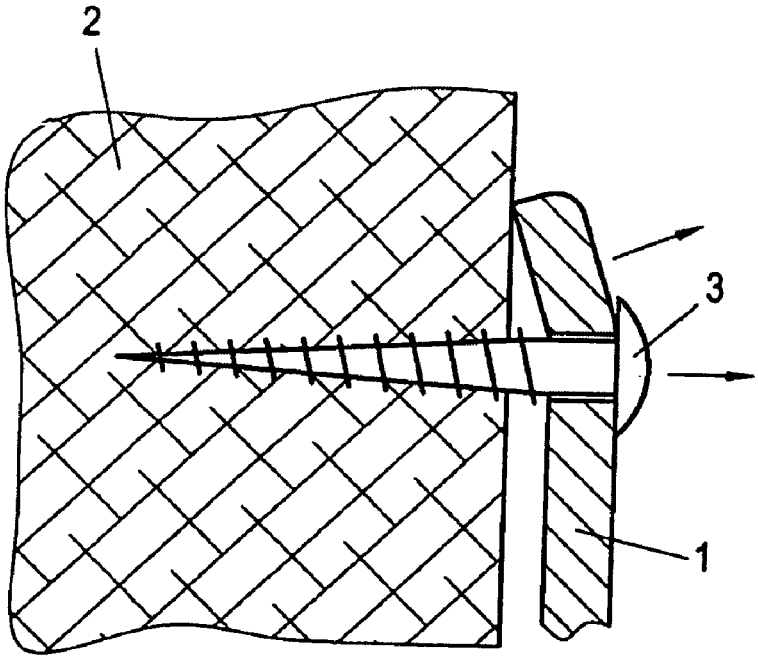
Fig. 2 Prior Art

As shown in FIGS. 1 and 2 a prior-art bracket is firmly screwed with its anchor plate 1 to a wall 2 by screws 3 or by unillustrated drive pins. A heavy loading of support plate 4 creates traction in the direction of arrow 5 that results in a bending out of the anchor plate 1. A condition as shown in FIG. 2 is brought about at the upper mounting screw 3. The overhanging end of the anchor plate 1 acts like a lever on the mounting screw 3, which weakens its hold.

OBJECTS OF THE INVENTION

It is therefore an object of the present invention to provide an improved wall bracket.

Another object is the provision of such an improved wall bracket that overcomes the above-given disadvantages, in particular that avoids the above-described disadvantage, by keeping the mounting force high if the bending out of the anchor plate occurs as a consequence of high tractile forces.

This result should also be able to be obtained if the wall thickness of the bracket is kept as small as possible and if customary aluminum alloys or other metallic alloys are used whose strength is comparatively limited.

SUMMARY OF THE INVENTION

A mounting bracket for securing to an upright wall has according to the invention an anchor plate formed with an upper horizontally throughgoing mounting hole and having a back face engageable with the wall, and a support plate fixed to and extending horizontally from the anchor plate below the upper mounting hole. The back face is formed between the upper mounting hole and an upper edge of the anchor plate with a bevel having a bevel face extending upward away from the wall.

The bracket in accordance with the invention is therefore characterized in that the anchor plate has a bevel along its upper edge and/or lower edge and starting from the wall side of the anchor plate. According to a further feature of the invention the bevel is located with its beveled edge in the area of the mounting hole or holes. The bevel edge is located in an advantageous manner between the mounting hole or holes and the upper edge or lower edge of the anchor plate, in particular along the end edge of the mounting hole or holes.

The anchor plate and the support plate preferably consist of one piece of a metal consisting of aluminum or aluminum alloy. The support plate and the anchor plate can be reinforced by struts. In a preferred manner the support plate has one or more clamping tongues.

SPECIFIC DESCRIPTION

Figure 3:
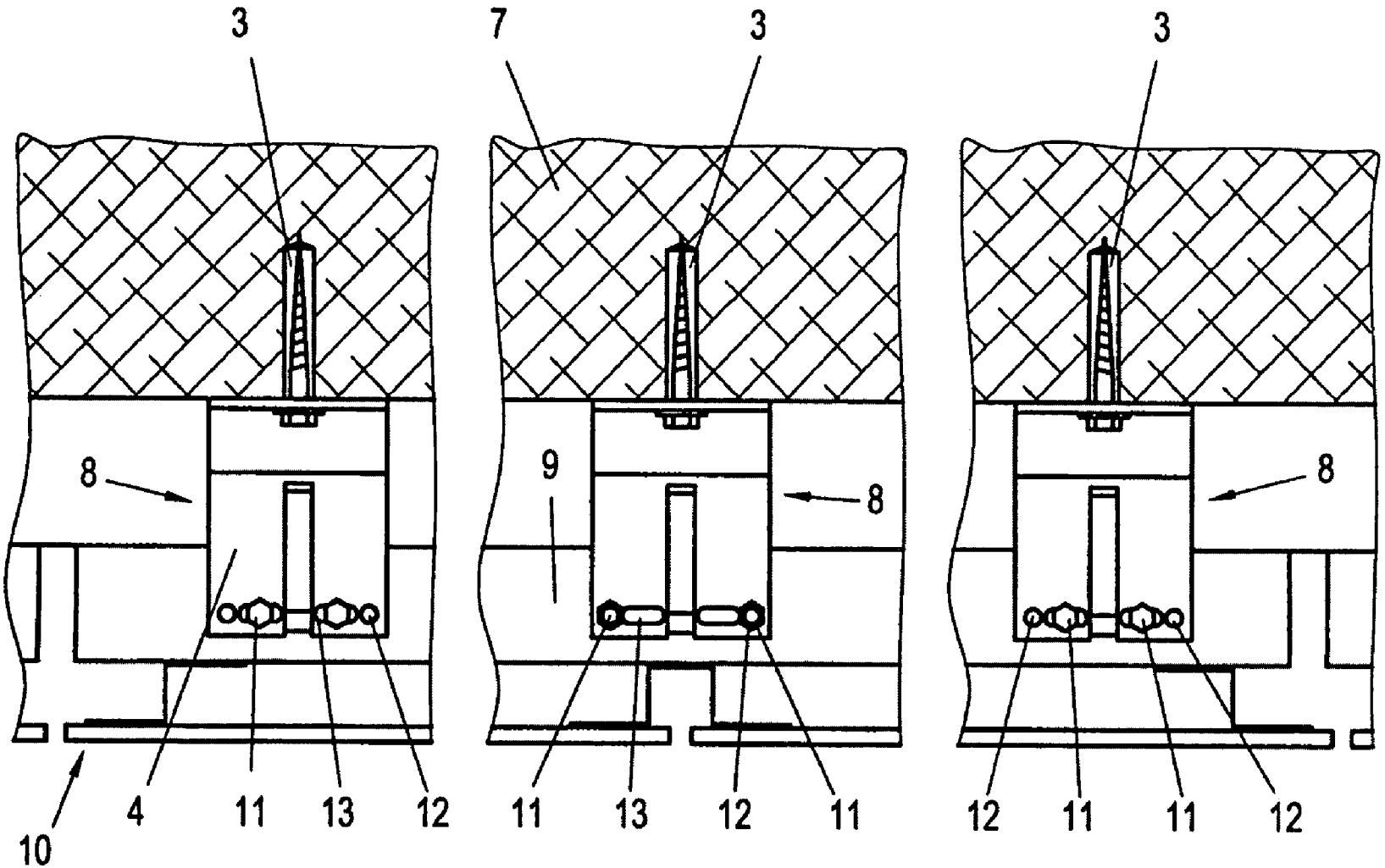
FIG. 3 is a bottom partly sectional view of brackets for supporting facade panels from behind.

FIG. 3 shows a building wall from below with the structural elements of a facade hung in front. The brackets 8 are arranged adjacent to each other spaced apart in a horizontal row on a wall 7 and are secured against the planar front face of the wall by the mounting screws 3. The distance between the brackets can be selected as desired. A mounting flange 9 carrying a facade panel 10 in front of the brackets 3 rests on the support plates 4. The mounting flange 9 is secured to the brackets by screws 11. In the mounting method shown the middle bracket 3 is firmly connected as a fixed point in that the screws 11 are screwed tightly into complementary round holes 12. In contrast the two other flanking brackets 3 have the screws 11 passing through transversely elongated slots or holes 13. This makes it possible to compensate for longitudinal (here horizontal) thermal expansion of the panels 10 and their flanges 9. Such thermal expansion takes place, e.g. under solar irradiation of the facade or, inversely, shrinkage occurs under the action of cold.

Under a high weight load on the brackets or by tractile forces such as, e.g. under the influence of wind the tractile loading of the brackets and a central bending out of the anchor plates can occur, as described above.

Figure 4:
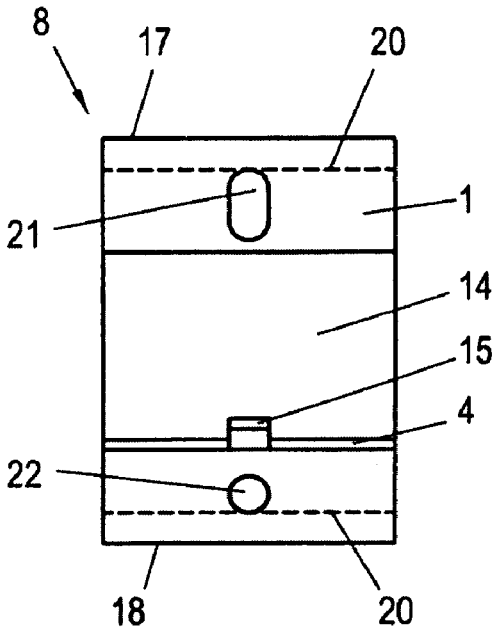
FIGS. 4, 5 and 6 are front, left-hand side, and bottom views of a bracket in accordance with the invention.
Figure 5:
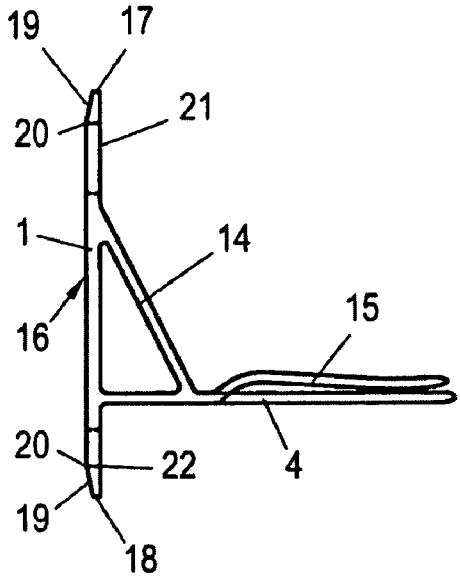
Figure 6:
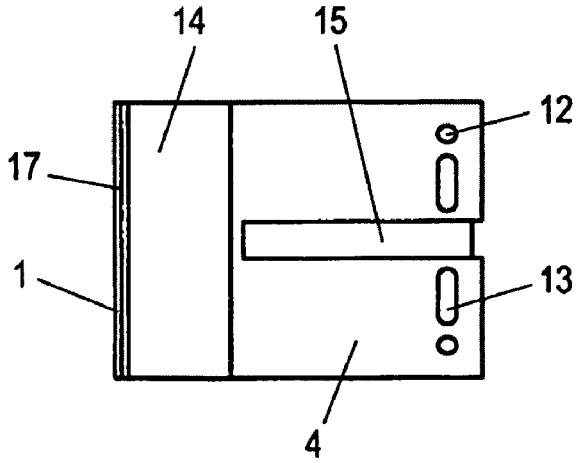

FIGS. 4 to 6 show a first embodiment of the bracket in accordance with the invention. It is cast in one piece from aluminum alloy such as, for example, EN AW-6060-t88. This is a standard material for such a use.

Here the vertical anchor plate 1 carries the support plate 4 on its front side, with the support plate 4 projecting horizontally at a right angle from the anchor plate 1. A brace strut 14 is also unitarily formed with the bracket and is a component of the cast profile. This strut 14 is straight and extends at an angle of about 30° to the vertical anchor plate 1 and 60° to the horizontal support plate 4. A clamping tongue 15 is stamped out of the support plate 4 and is bent outward and upward and serves for easy mounting, e.g. of the mounting flange 9 (see FIG. 3).

The dimensions shown are only exemplary and can be adapted within wide limits to the requirements.

As can be seen in particular in FIG. 5, the anchor plate 1 is provided on its back wall side 16 with bevels 19 running along its upper and lower end edges 17 and 18. In the illustrated embodiment and as shown in FIG. 4, the bevels 19 extend from the respective end edges 17 and 18 to the respective inner bevel edge 20 where the bevels 19 merge with the planar back face of the plate 1. Each bevel edge 20 is located between the respective upper or lower oblong mounting hole 21 or 22 and the respective end edge 17 or 18. The advantage of this preferred embodiment is that the contact pressure of the mounting screws presses with the full surface 16 on the structure of the building or on other substrate or support. However, if a bending out of the anchor plate 1 occurs on account of tractile forces that are too high, the creation of lever action as shown in FIG. 2 is avoided because as a result of the bevels 19 no support of the end edges 17 or 18 on the support structure can take place and therefore this lever action does not occur. The anchor plate 1 thus has turned toward the wall 2 a back face with a rectangular and planar central portion 16 whose upper and lower edges are defined by the inner edges 20 of the bevels 19, which in turn are planar rectangular surfaces extending at a small acute angle upward and downward away from the planar face of the wall 2.

FIG. 6 shows a top view of the bent-up clamping tongue 15 and of the oblong holes or slots 13 and round holes 12 formed in the outer region of the support plate 4. The holes 12 and 13 can be used to fasten facade mounting parts or the like, as is shown in FIG. 3.

Figure 7:
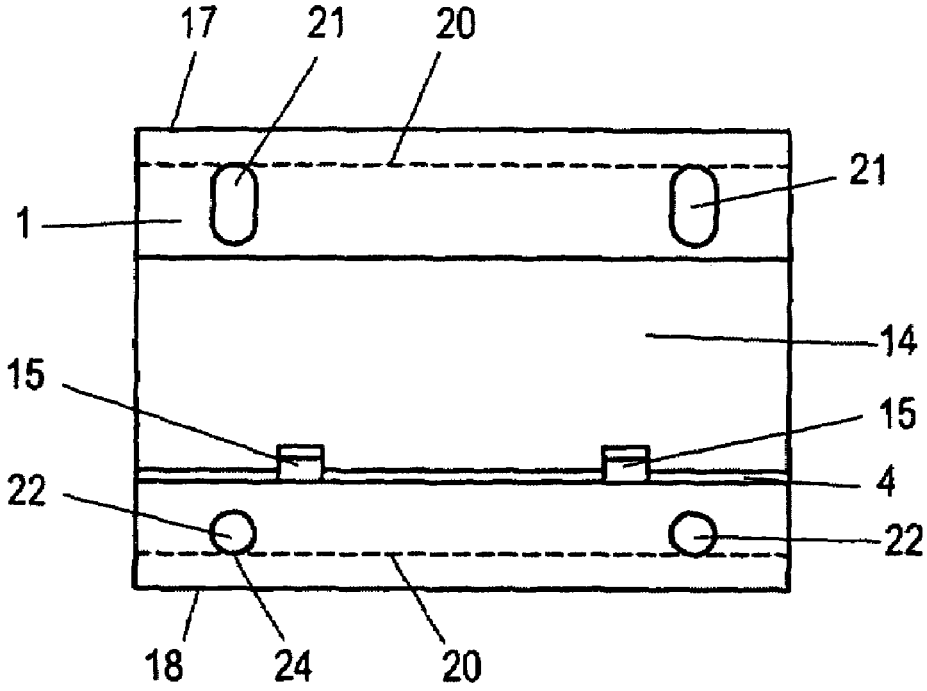
FIG. 7 is a front view of another bracket.

FIG. 7 shows in front view another embodiment of the bracket that is in fact a doubling of the bracket according to FIGS. 4 to 6. Accordingly, there are two upper oblong mounting holes 21 and two lower round mounting holes 22 and two clamping tongues 15 at the sides of which the corresponding mounting holes 12 and 13 (not shown) are also provided. The side view corresponds to FIG. 5.

Figure 8:
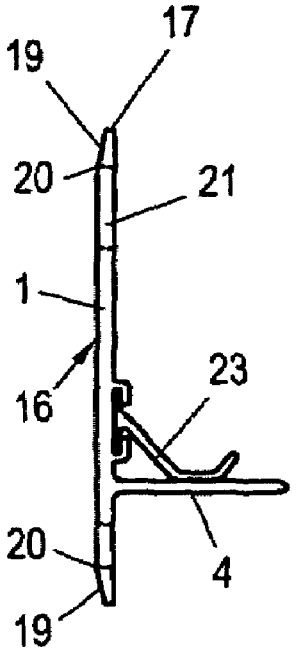
FIGS. 8 and 9 are side views of other brackets according to the invention.
Figure 9:
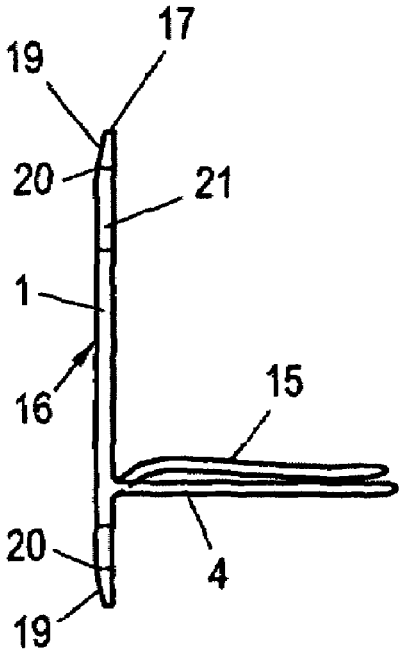

FIG. 8 shows another example for such a bracket, in which, however, the projection of the support plate is so small that the brace 14 is eliminated. Instead of the clamping tongue a clamping flap 23 is provided whose upper end slides in a T-slot formed in the plate 1. FIG. 9 shows a dimensioning of support plate 4 that has a clamping tongue 15 but no strut 14.

All embodiments have in common the arrangement of bevels 19 parallel to and inward of the end edges 17 and 18 of the support plates 1.

The building wall shown in FIG. 3 can of course also be any other support structure on which the brackets in accordance with the invention can be fastened. The mounting screws 3 can also be other mounting elements, e.g. dowels, drive pins, clamps and rivets. The brackets in accordance with the invention can receive up to 50% higher tractile loads then the same brackets without the features of the invention. Analogously, the dimensions of the brackets, in particular the protection of the support plate, can be enlarged with the same loading capacity.

In an illustrated embodiment in practice the total height of the anchor plate is 135 mm. The material thickness of the anchor plate is approximately 4 mm and tapers at the end edges to 1.5 mm. The projection of the protruding support plate is, for example, between 35 mm and 290 mm; however, a projection up to 270 mm can be achieved. The wall thickness of the support plate is 4 mm and tapers toward the front end down to 2.5 mm in the embodiments with clamping tongue. The wall thickness of the strut is approximately 3 mm. All these measurements are only examples and do not limit the invention.

We claim:

1. A mounting bracket for securing to an upright wall, the bracket comprising:

an anchor plate formed with an upper horizontally throughgoing mounting hole and a lower horizontally throughgoing mounting hole below the upper hole, the anchor plate having a back face engageable flatly with the wall; and a support plate fixed to and extending horizontally from the anchor plate below the upper mounting hole, the back face being formed between immediately adjacent the upper mounting hole and an upper edge of the anchor plate with a bevel having a bevel face extending upward away from the wall and between immediately adjacent the lower mounting hole and a lower edge of the anchor plate with a bevel having a bevel face extending downward away from the wall.

2. The mounting bracket defined in claim 1 wherein a lower edge of the bevel is tangent to the upper hole.

3. The mounting bracket defined in claim 1 wherein the plates are unitarily formed of metal.

4. The mounting bracket defined in claim 1 wherein the metal is aluminum or an aluminum alloy.

5. The mounting bracket defined in claim 1, further comprising a brace strut extending diagonally between the anchor plate and support plate.

6. The mounting bracket defined in claim 1 wherein the support plate is unitarily formed with a clamping tongue.

7. The mounting bracket defined in claim 1 wherein the support plate is formed with throughgoing mounting holes.

8. The mounting bracket defined in claim 1, further comprising:

an elastically deformable clamping tongue having a rear end mounted on the anchor plate and a front end bearing elastically vertically on the support plate.

9. The mounting bracket defined in claim 1 wherein the back face is substantially planar between the bevel faces.

10. The mounting bracket defined in claim 9 wherein the bevel faces are substantially planar and form small acute angles with the back face.

11. A mounting bracket for securing to an upright wall, the bracket comprising:

an anchor plate formed with an upper horizontally throughgoing mounting hole and having a back face engageable with the wall; and a support plate fixed to and extending horizontally from the anchor plate below the upper mounting hole, the back face being formed between the upper mounting hole and an upper edge of the anchor plate with a bevel having a bevel face extending upward away from the wall, the support plate being formed with at least one throughgoing round hole and at least one throughgoing oblong hole or slot elongated generally parallel to the anchor plate.

* * * * *